United States Patent [19]

Armstrong

[11] 4,100,913

[45] Jul. 18, 1978

[54] FIREPLACE HEATING SYSTEM

[76] Inventor: Ernest DeLoy Armstrong, 5523 Latigo, Boise, Id. 83705

[21] Appl. No.: 518,414

[22] Filed: Oct. 29, 1974

[51] Int. Cl.[2] ..... F24B 7/00

[52] U.S. Cl. ..... 126/121; 237/51; 126/131

[58] Field of Search ..... 126/120, 121, 131, 110 AA; 237/51, 52, 53, 55, 47; 236/49

[56] References Cited

U.S. PATENT DOCUMENTS

| | | | |
|---|---|---|---|
| 2,231,258 | 2/1941 | Elmore | 126/121 |
| 2,277,381 | 3/1942 | Black | 126/121 |
| 2,322,016 | 6/1943 | Hardeman | 126/121 |
| 2,647,506 | 8/1953 | Heiman | 126/110 AA |
| 2,671,440 | 3/1954 | Dupler | 126/121 |
| 3,684,170 | 8/1972 | Roof | 236/49 X |

*Primary Examiner*—Ronald C. Capossela
*Attorney, Agent, or Firm*—Clarence M. Crews

[57] ABSTRACT

A fireplace heating system is provided which may be arranged to heat with unique efficiency the room in which the fireplace is situated and/or any desired number of additional rooms within the capacity of the system. The system is characterized by the fact that air is collected from the top of the room or rooms being heated where, though still warm, it has, because of its location, lost its capability of serving the occupants. The air so collected is transmitted downward through a heat exchanger in which the hot products of combustion from the fireplace are traveling upward. The air thus reheated is distributed to the involved rooms either at floor level, or from beneath the floor. It is a significant feature that the recycled, breathable air, while being driven downward through the heat exchanger, is kept separated from the products of combustion. It is nevertheless maintained in intimate heat exchanging relation with such products by causing such products to travel upward in the heat exchanger, through several heat conductive tubes of relatively small cross-section and therefore of relatively large surface area in relation to flow capacity. A remotely controlled, variable speed fan is desirably employed for driving the collected air downward through the heat exchanger. The air is returned in large volume but at moderate velocity and at a temperature which is comfortable to the human body.

2 Claims, 4 Drawing Figures

FIREPLACE HEATING SYSTEM

This invention relates to fireplace heating systems and has for its primary object to utilize a fireplace with unprecedented efficiency for heating one or more rooms of a building.

It is common practice to provide a fireplace which is more ornamental than useful. Such a fireplace, for example, is generally provided in a room to serve that room only. All the hot products of combustion go directly up the chimney and are discharged outdoors. The breathable air in the room is heated only by radiation, and the air thus heated rises by convection to the ceiling where it is of no use to occupants of the room. The fire is maintained by drawing its oxygen supply from the breathable, radiantly heated air at fireplace level in the room in which the fireplace is situated. In such an arrangement not even a single room can generally be made comfortable, since most of the heat is wasted up the chimney and a considerable portion is wasted through the upper walls and the ceiling.

In accordance with the present invention these shortcomings are obviated and the fireplace is usefully, comfortably and efficiently employed to heat either the entire building or a substantial selected portion of it.

To this end warm breathable air is collected from the top of the room or rooms served and is driven downward through a heat exchanger. The heat exchanger maintains the descending breathable air out of contact with the hot, rising products of combustion but in intimate heat exchanging relation therewith.

The products of combustion, therefore, are discharged to the atmosphere deprived of much of the heat which would normally be wasted, while the warm, breathable air withdrawn from the top of a room or rooms is driven slowly down through the heat exchanger at a retarted rate to or below the floor level of the room or rooms from which it was withdrawn, and is returned in reheated condition to such room or rooms either directly or through floor registers.

A system of this kind is extremely satisfactory, in part because the reheated, breathable air may be returned to the rooms from beneath the floors and hence serves to warm the floors, a very desirable feature where young children are involved.

Such a system has the further merit that the driving downward of breathable air through a heat exchanger is contrary to the tendency of warmer air to rise by convection. It, therefore, causes the air to linger in the heat exchanger to a desirable degree and, as it is heated, to produce turbulence and effective mixing.

Such a system has the further merit that efficient heat interchange is promoted by the extensive contact with the conductive walls of the heat exchanger of the products of combustion on the one hand and the recirculated, breathable air on the other.

The entire system can desirably be controlled from the room or rooms served by the fireplace. A damper located high in the system is controlled from the fireplace. The withdrawal of air from a given room may be controlled by a ceiling register, operable by pull cords, or other suitable means. The supplying of warmed air to a given room may be controlled through a floor register or equivalent means. A plural speed fan for driving collected air downward is remotely controlled from a switch located in the same room as the fireplace. It should be noted, however, that the returned air should be put through the heat exchanger rapidly enough to limit its rise of temperature to a level which is comfortable to the human body. At the same time, it should be discharged at a velocity which is not objectionably high. To these ends, the flow capacity of the air return system should be reasonably large at the intake and discharge ends, as shown in the drawing. Other objects and advantages will hereinafter appear.

In the drawing forming part of this specification,

Figure 1:
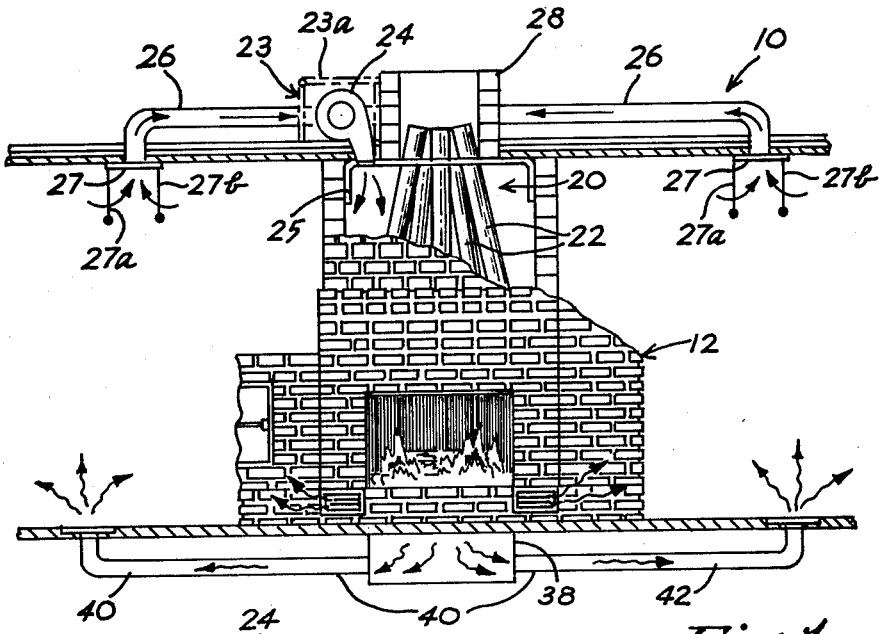
FIG. 1 is a comprehensive, fragmentary view, partly broken away and partly in sectional elevation, showing a fireplace and portions of an air recirculating system.

In FIG. 1 disclosure is made of a heating system 10 which comprises a fireplace 12 that includes the usual masonry construction. The fireplace includes a hearth 14, and a novel metallic unit 16. The unit 16 includes a metallic firebox 18 and significant parts of a heat exchanger 20. The heat exchanger 20 forms part of the fireplace flue and includes a group of tubes 22 desirably of comparatively small and equal cross-sections and large surface area. The tubes at their lower ends extend through the upper wall of the firebox 18 and have sealed communication therewith. The front of the upper part of the heat exchanger may be closed in any suitable heat insulating manner, as by a series of tiles 25*a*. The tiles protect conventional wooden parts of the building structure such as a wooden header 25*b* and wooden top plates 25*c*.

Air from the tops of the rooms served, this being the warmest air in the rooms, is withdrawn by a fan 24, located in a fan box 23, through one or more ducts 26, and blown down through the heat exchanger 20, having extensive exposure to contact with the outer surfaces of tubes 22. Admission of air to the air ducts 26 is controlled by ceiling registers 27. Each register desirably has two pull cords 27*a* and 27*b*, one for opening the register and the other for closing it. Alternatively, the register may be adapted for operation by a short, hooked window pole.

The design of the exchanger is a matter of importance. The combined flow capacity of the tubes 22 must be ample to carry away the products of combustion of a brisk fire and deliver them freely to the chimney. This should be done without any forced draft so that the passage of the hot products of combustion through the heat exchanger will not be needlessly hurried.

The transmission of the hot products of combustion is taken care of through a multiplicity of thin-walled tubes 22, five as shown, composed of a highly conductive metal or metallic alloy. The reason for multiplying the tubes is to increase the total heat exchanging surface area, and hence the heat transfer efficiency of the heat exchanger.

The flow capacity of the tubes will be proportional to their combined cross-sectional area while the combined surface area, which bears directly upon the efficiency of heat transfer, is proportional to the sum of the perimeters or circumferences.

If the discharge of the hot products of combustion were taken care of by a single ample cylindrical tube of radius $r$, the circumference would be $2\pi r$ and the cross-sectional area $\pi r^2$.

If, however, the same total cross-sectional or flow area is provided by $n$ tubes of equal radius $r_1$, the cross-sectional area $\pi r^2$ will be equal to $n\pi r_1^2$.

Thus, since $$n\pi r_1^2 = \pi r^2$$

$$r_1\sqrt{n} = r$$

and $$2\pi n r_1 = 2\pi r\sqrt{n}$$

Thus the subdivision of the flow path of the hot products of combustion into $n$ equal channels of a given shape, while keeping the flow path the same, multiplies the heat exchange surface by $\sqrt{n}$, greatly increasing the efficiency of heat exchange.

Applied specifically, if a tube of specified flow capacity (cross-section) is replaced by five smaller tubes having the same combined flow capacity as the original tube, the combined surface area of a unit length of the combined tubes will be equal to that unit length of the original tube, multiplied by $\sqrt{5}$. I have found the employment of as many as five tubes to be of great practical advantage and well worth while, but since the increased heat exchange efficiency is proportional only to the square root of the number of tubes, the utilization of this principle has obvious practical limitations.

The flow capacity of the heat exchanger for the breathable air being returned is desirably made substantially to exceed the combined flow capacity of the tubes 22. This enables the air being returned to linger in the heat exchanger for more effective reheating therein. It also permits the hottest air to reverse direction by convection, thereby to produce turbulence and a more thorough mixing, with a consequent more uniform temperature of the air returned and discharged.

Figure 3:
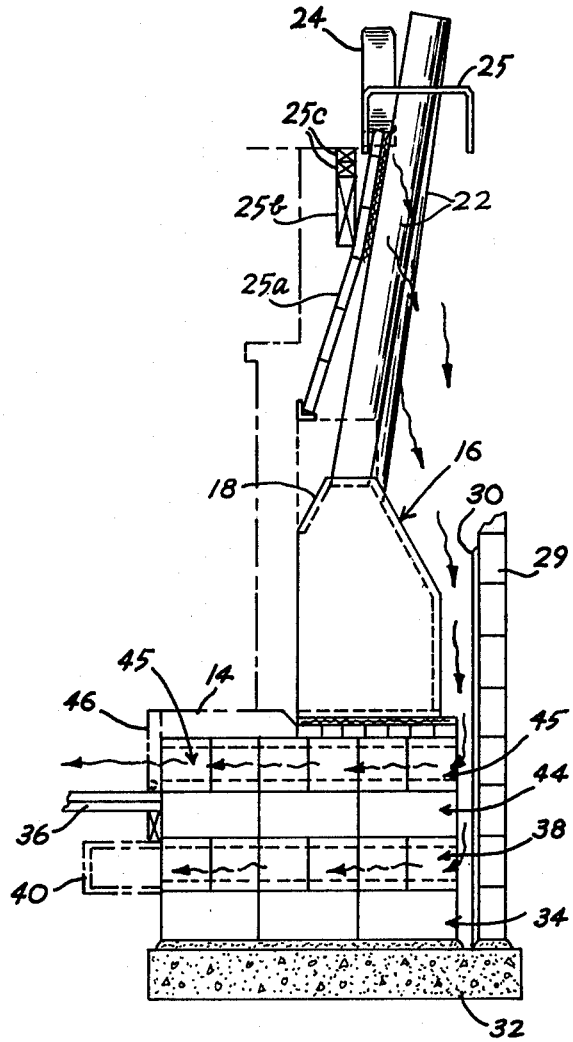
FIG. 3 is a fragmentary view in side elevation of the fireplace structure shown in FIG. 2.
Figure 4:
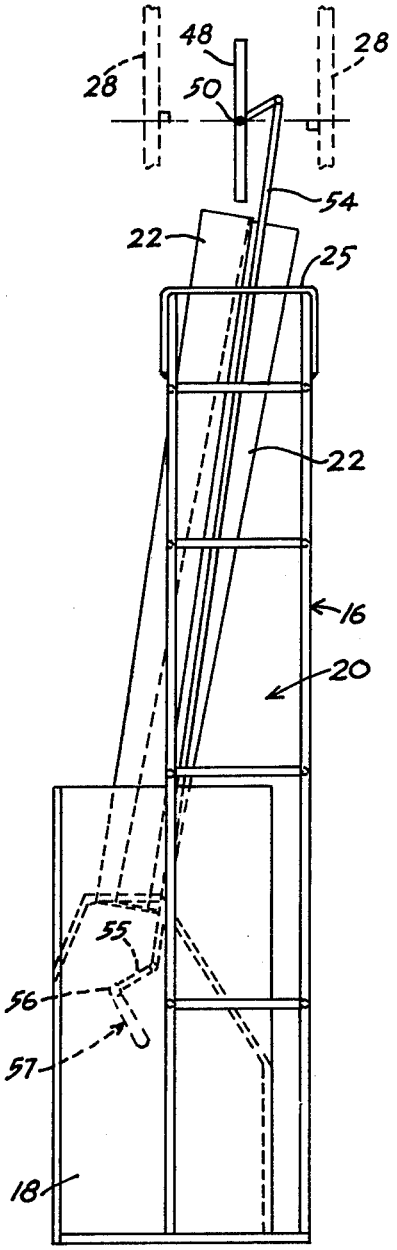
FIG. 4 is a view in side elevation on a larger scale than FIG. 3, showing particularly the fireplace unit independent of masonry.

Beyond the lower ends of the pipes 22, the air being reheated and returned travels through a narrowing space to the rear of the superheater firebox (see FIGS. 3 and 4). The firebox itself is of heat conductive, metallic construction and is normally very hot. The firebox, itself, therefore, constitutes an important part of the heat exchanger. This part of the heat exchanger at its narrowest part desirably measures only about three or four inches from front to rear and as a heat exchanger it terminates substantially at hearth level. Below that level it may be further narrowed and it becomes an air distributor. It is bounded at the rear by a ceramic wall 29 which is lined by a metallic plate 30.

The entire fireplace and a substantial portion of the air distributing structure rests on a concrete slab 32 which rests upon the ground. Upon this slab 32 there is desirably provided a first tier 34 of hollow concrete blocks, so disposed that none of the returned air can pass through them.

Upon the tier 34 of blocks, and still below the level of floor 36, is a second tier 38 of hollow concrete blocks, one or more lines of which may be disposed with the block cavities aligned and communicating to form air transmitting passages in communication with conduits 40 and 42 which discharge upward through floor registers to different portions of the building.

The conduits 40 and 42 are shown in the drawing as discharging into the same room in which the fireplace is located. It is to be understood, of course, that 40 and 42 may be arranged to discharge into rooms distinct from one another and from the room in which the fireplace is located. Additional conduits like 40 and 42 may also be provided for delivering rewarmed air to additional rooms. Each room to which air is delivered will be equipped with an air withdrawing conduit 26 and additional fans 24 may be provided if required for delivering withdrawn air to the heat exchanger 20. Ordinarily, however, all conduits 26 will deliver to the same fan box. If it is desired to exclude an available room from the active system, the floor and ceiling registers of that room will be closed.

Upon the tier 38 there is provided a third tier of blocks 44. This tier is like the tier 34 and has its upper surface disposed substantially at floor level. Upon the tier 44 is a fourth tier 45 like the tier 38. The tier 45 supports the hearth 14 and discharges rewarmed air at floor level directly into the room in which the fireplace is located. The ducts through 45 may be opened and closed by registers 46. As shown, one or more ducts 26 pick up the air from the top of this room and deliver it, under fan propulsion, to the heat exchanger.

The chimney 28 desirably includes, above the heat exchanger, a damper 48 which turns through ninety degrees or less upon a horizontal axis 50 to any desired position between fully open and fully closed positions. The damper 48 includes an actuating arm 52 which, as shown, is connected through a link 54 to an arm 55 within the heat exchanger, which arm is parallel to arm 52. The arm 55 is fast on a horizontal shaft 56 which extends through a firebox wall to an exposed position. An operating arm 57 fast on an exposed portion of shaft 56 serves as a damper operator.

With the damper located high in the chimney, the damper operating means illustrated enables it to be set in various selected positions from the first floor alongside the fireplace.

Ceiling registers 27 may also be controlled through pull chains **27*a* and 27*b*** from the first floor.

Figure 2:
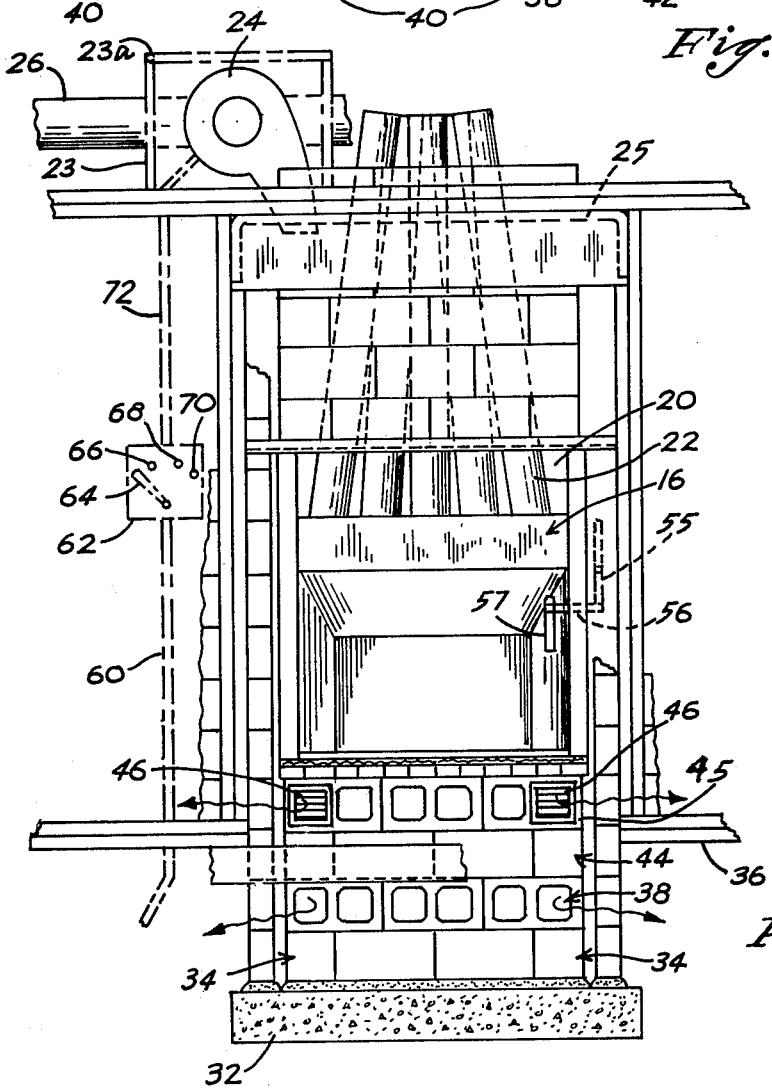
FIG. 2 is a fragmentary view in front elevation of the fireplace and immediately associated structure on a larger scale than FIG. 1, with portions of the building structure either broken away or omitted.

It is desirable that the fan 24 be a plural speed fan and that it be controllable from the first floor. A concealed electrical supply cable 60, containing the requisite conductors, is accordingly provided for supplying electrical energy to a switch box 62 which is desirably mounted in a wall recess of the room in which the fireplace is located. A switch 64 is shown in the "off" position in FIG. 2, but it may be caused selectively to energize the fan through "low", "medium" and "high" contacts, 66, 68 and 70. An electrical cable 72 encloses insulated wires, not shown in detail, for driving the fan at slow, medium or high speed, respectively, according to the setting of the switch. Since variable speed fans are a common article of commerce there is no need for illustrating this arrangement in detail.

A seen in the drawing (FIGS. 1 and 2), all of the passages in tier 46 are permanently covered and closed by bricks, except the extreme right hand and left hand passages.

Those passages of the tieres 38 and 45 which are not used may be closed permanently by cement. If preferred, however, a removable cover or removable covers can be provided for them so that future alteration to render one or more of them active is available.

I have described what I believe to be the best embodiment of my invention. What I desire to cover by letters patent, however, is set forth in the appended claims.

I claim:

1. A fireplace heating system for a building structure comprising, in combination, (a) a fireplace including a firebox, (b) a chimney, (c) a heat exchanger bounded in part by the firebox and including a multiplicity of heat conductive metallic tubes which connect the fireplace with the chimney, whereby the hot products of combustion are all adequately conducted to the chimney for discharge to the outside atmosphere, the heat exchanger including a chamber of larger flow capacity than the combined tubes, through which chamber the tubes pass, (d) means for withdrawing breathable air from the top of a room and propelling it downward through said chamber of the heat exchanger for exposure to contact with the outsides of the tubes thereof, (e) means for delivering the reheated air from the heat exchanger to the lower, habitable part of a room of the building, said withdrawing and delivering means having a flow capacity nearly enough comparable to that of the heat exchanger chamber to avoid objectionable overheating of the returned air and also to avoid discharge of the returned air at an objectionably high velocity, and (f) a firm support for the fireplace, said support including a tier composed essentially of hollow concrete blocks disposed above floor level and constructed and arranged to form continuously open passage means volumetrically proportioned to deliver moderately reheated, returned air at low velocity and in substantial quantity to the room in which the fireplace is located, at points substantially at floor level.

2. A fireplace heating system for a building structure comprising, in combination, (a) a fireplace including a firebox, (b) chimney, (c) a heat exchanger bounded in part by the firebox and including a multiplicity of heat conductive metallic tubes which connect the fireplace with the chimney, whereby the hot products of combustion are all adequately conducted to the chimney for discharge to the outside atmosphere, the heat exchanger including a chamber of larger flow capacity than the combined tubes, through which chamber the tubes pass, (d) means for withdrawing breathable air from the top of a room and propelling it downward through said chamber of the heat exchanger for exposure to contact with the outsides of the tubes thereof, (e) means for delivering the reheated air from the heat exchanger to the lower, habitable part of a room of the building, said withdrawing and delivering means having a flow capacity nearly enough comparable to that of the heat exchanger chamber to avoid objectionable overheating of the returned air and also to avoid discharge of the returned air at an objectionably high velocity, (f) a firm support for the fireplace, said support including a tier composed essentially of hollow concrete blocks disposed below floor level and arranged to provide continuously open passage means for receiving reheated, returned air from the heat exchanger, and (g) conduit means constructed and arranged to receive such reheated air from said passage means, conduct it beneath the floor to an area remote from the fireplace, and to discharge it upward through the floor to a habitable area.

* * * * *